US009509103B2

(12) United States Patent
Liu et al.

(10) Patent No.: US 9,509,103 B2
(45) Date of Patent: Nov. 29, 2016

(54) ELECTROSTATIC DISCHARGE PROTECTION

(71) Applicant: Nokia Corporation, Espoo (FI)

(72) Inventors: Yinong Liu, Beijing (CN); Pi Lin, Beijing (CN)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 14/316,779

(22) Filed: Jun. 26, 2014

(65) Prior Publication Data

US 2015/0004842 A1 Jan. 1, 2015

(30) Foreign Application Priority Data

Jun. 28, 2013 (CN) ..... 2013 1 0268617

(51) Int. Cl.
*H01R 13/66* (2006.01)
*H01R 13/703* (2006.01)
*H01R 24/58* (2011.01)

(52) U.S. Cl.
CPC ..... *H01R 13/7033* (2013.01); *H01R 24/58* (2013.01); *Y10T 29/49208* (2015.01)

(58) Field of Classification Search
CPC H01R 24/58; H01R 2107/00; H01R 13/703; H01R 13/7033; H01R 13/6658; H01R 13/665
USPC ..... 439/188, 620.21, 668, 669, 51.1
See application file for complete search history.

(56) References Cited

U.S. PATENT DOCUMENTS

| | | | | |
|---|---|---|---|---|
| 5,893,767 | A * | 4/1999 | Broschard, III | 439/188 |
| 6,077,126 | A * | 6/2000 | Peng | 439/668 |
| 6,524,138 | B1 * | 2/2003 | Li et al. | 439/669 |
| 6,575,793 | B1 * | 6/2003 | Li et al. | 439/668 |
| 6,808,404 | B1 * | 10/2004 | Doyle et al. | 439/188 |
| 7,331,825 | B2 * | 2/2008 | Xue et al. | 439/668 |
| 8,287,314 | B1 * | 10/2012 | Gao et al. | 439/668 |
| 8,465,329 | B2 * | 6/2013 | Fields et al. | 439/668 |
| 8,602,801 | B2 * | 12/2013 | Sylvester et al. | 439/188 |
| 2002/0151201 | A1 | 10/2002 | Bohbot | |
| 2008/0032562 | A1 * | 2/2008 | McHugh et al. | 439/668 |
| 2011/0237131 | A1 * | 9/2011 | Fields et al. | 439/620.21 |
| 2012/0052705 | A1 | 3/2012 | Su et al. | |
| 2012/0142225 | A1 * | 6/2012 | Hansson et al. | 439/669 |

FOREIGN PATENT DOCUMENTS

| | | | |
|---|---|---|---|
| CN | 1845388 | A | 10/2006 |
| CN | 201887270 | U | 6/2011 |
| JP | 2011171036 | A | 9/2011 |
| JP | 5161394 | B1 | 3/2013 |

* cited by examiner

*Primary Examiner* — Tulsidas C Patel
*Assistant Examiner* — Peter G Leigh
(74) *Attorney, Agent, or Firm* — Harrington & Smith

(57) ABSTRACT

An apparatus comprising: a connector for providing an electrical interface, the connector comprising an opening configured to receive a suitable member; at least one conductive contact located at least partially within the connector and configured to operate as a switch such that when the connector is in an unplugged to partially plugged state the at least one conductive contact is grounded and when the connector is in a partially plugged to a fully plugged state the at least one conductive contact is coupled to an electrical terminal channel interfacing an electrical signal between the connector and the member.

18 Claims, 10 Drawing Sheets

ELECTROSTATIC DISCHARGE PROTECTION

FIELD OF THE APPLICATION

The present application relates to a method and apparatus for electrostatic discharge protection for connectors. In some embodiments the method and apparatus relate to for electrostatic discharge protection for audio jacks.

BACKGROUND OF THE APPLICATION

Some portable electronic devices comprise transducers such as loudspeakers and/or earpieces which are required to be small in size. Transducers are important components in electronic devices such as mobile phones for the purposes of playing back music or having a telephone conversation. The quality and loudness of a transducer in an electronic device are important especially if a user listens to sounds generated by an electronic device at a distance from the electronic device.

Furthermore portable electronic devices are often provided with connectors or ports or sockets to provide coupling to external devices, such as microphones, headphones, audio-video-equipment, and displays. These ports, sockets or jacks are configured to receive plugs (or can receive other members or conductive elements such as a charged finger) which can be ungrounded and contain electrostatic potentials sufficient to cause damage to sensitive components within the device.

SUMMARY OF SOME EMBODIMENTS

In a first aspect of the application there is provided an apparatus comprising a connector for providing an electrical interface, the connector comprising an opening configured to receive a member; at least one conductive contact located at least partially within the connector and configured to operate as a switch such that when the connector is in an unplugged to partially plugged state the at least one conductive contact is grounded and when the connector is in a partially plugged to a fully plugged state the at least one conductive contact is coupled to an electrical terminal interfacing an electrical signal between the connector and the member.

The connector may be an audio jack and wherein the electrical terminal may be a microphone terminal.

The at least one conductive contact may comprise a spring portion biased to couple at least a first part of the at least one conductive contact to a grounded connector.

The at least one conductive contact may comprise a contact portion coupled to the first part of the at least one conductive contact, and wherein the contact portion may be configured to receive the member and move the first part of the at least one conductive contact away from the first grounded connector against the bias of the spring portion of the at least one conductive contact.

The at least one conductive contact may comprise a metal pin comprising a first arm fixed to the connector, a bended portion which at one end is coupled to the first arm and operating as the spring portion, a second arm coupled the bended portion at the other end, the second arm configured to operate as the first part of the at least one conductive contact and the contact portion.

The at least one conductive contact may be located at the opening of the connector.

The at least one conductive contact may be located proud of the opening of the connector such that the conductive contact connects with the suitable member as the suitable member is inserted into the connector.

The member may comprise at least one conductive contact configured to co-operate with the apparatus at least one conductive contact so as to provide an electrical interface with the connector.

The electrical terminal may be configured to be coupled to an external device via the member, and further configured to transmit a signal from the connector to the external device via the member.

According to a second aspect there may be provided an apparatus comprising: means for providing an electrical interface, the means for providing an electrical interface comprising means for receiving a conductive means; means for providing a contact with the conductive means located at least partially within the means for providing the electrical interface and configured to operate as a switch such that when the means for providing the electrical interface is in an unplugged to partially plugged state the means for providing a contact is grounded and when the means for providing an electrical interface is in a partially plugged to a fully plugged state the means for providing a contact is coupled to a means for interfacing an electrical signal between the means for providing an electrical interface and the conductive means.

The means for providing an electrical interface may be an audio jack and wherein the means for interfacing an electrical signal may be a microphone terminal.

The means for providing a contact may comprise a spring portion biased to couple at least a first part of the means for providing a contact to a grounded connector.

The means for providing a contact may comprise a contact portion coupled to the first part of the means for providing a contact, and wherein the contact portion may be configured to receive the conductive means and move the first part of the means for providing a contact away from the grounded connector against the bias of the spring portion of the means for providing a contact.

The means for providing a contact may comprise a metal pin comprising a first arm fixed to the means for providing an electrical interface, a bended portion which at one end is coupled to the first arm and operating as the spring portion, a second arm coupled the bended portion at the other end, the second arm configured to operate as the first part of the means for providing a contact and the contact portion.

The means for providing a contact may be located at the opening of the means for providing an electrical interface.

The means for providing a contact may be located proud of the means for receiving a conductive means such that the means for providing a contact connects with the conductive means as the conductive means is inserted into the means for providing an electrical interface.

The conductive means may comprise at least one conductive contact configured to co-operate with the apparatus means for providing a contact so as to provide an electrical interface with the means for providing an electrical interface.

The means for interfacing an electrical signal may be configured to be coupled to an external device means via the conductive means, and further configured to transmit a signal from the means for providing an electrical interface to the external device via the conductive means.

According to a third aspect there is provided a method comprising: providing a connector for providing an electrical interface, the connector comprising an opening configured to receive a suitable member; providing at least one conductive contact located at least partially within the connector; and operating the at least one conductive contact as a switch such that when the connector is in an unplugged to partially plugged state the at least one conductive contact is grounded and when the connector is in a partially plugged to a fully plugged state the at least one conductive contact is coupled to an electrical terminal channel interfacing an electrical signal between the connector and the member.

According to a fourth aspect there is provided an apparatus comprising: a casing configured to encapsulate the following components: at least one processor; at least one memory; at least one display; and a connector for providing an electrical interface, the connector comprising an opening configured to receive a suitable member; at least one conductive contact located at least partially within the connector and configured to operate as a switch such that when the connector is in an unplugged to partially plugged state the at least one conductive contact is grounded and when the connector is in a partially plugged to a fully plugged state the at least one conductive contact is coupled to an electrical terminal channel interfacing an electrical signal between the connector and the member.

An electronic device may comprise an apparatus as described above.

Embodiments of the present invention aim to address one or more of the above problems.

BRIEF DESCRIPTION OF DRAWINGS

For a better understanding of the present application and as to how the same may be carried into effect, reference will now be made by way of example to the accompanying drawings in which.

SOME EMBODIMENTS OF THE APPLICATION

Figure 1:
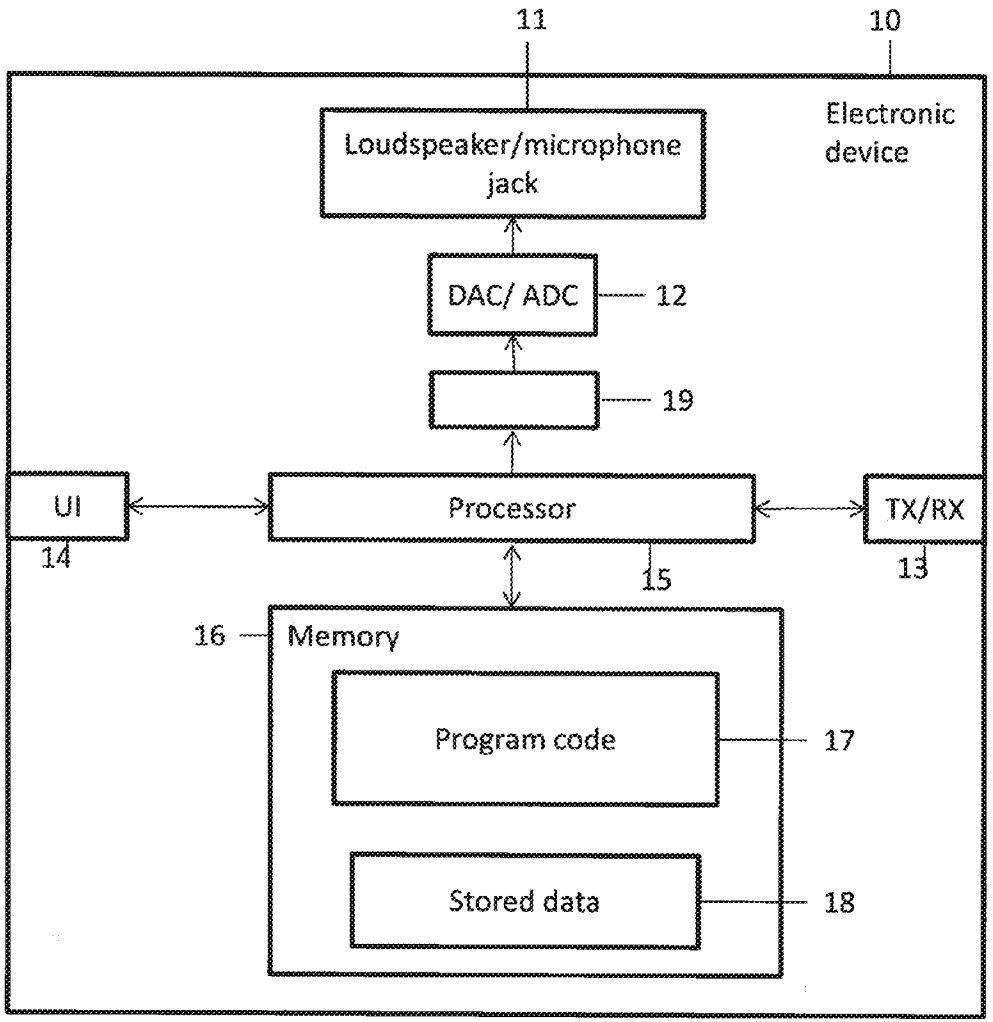
FIG. 1 illustrates a schematic block diagram of an apparatus according to some embodiments.

The following describes apparatus and methods for electrostatically protecting an apparatus at a connector/port/socket/jack.

As discussed herein a problem in modern electrical apparatus design reliability is electrostatic discharge failure. An example of which is where a connector/port/socket/jack is coupled to components such as audio/video drivers typically mounted on a printed wiring board/printed circuit board/flexible printed circuit (PWB/PCB/FPC). An electrostatic discharge (ESD) spark connecting to the connector or socket can generate an ESD current which passes through the connector or socket to the sensitive components.

Examples of ESD sparks can be those generated during type approval and product reliability testing. These can easily break modern audio and video integrated circuitry. The integrated circuitry is typically are not designed to handle ESD currents generated by ESD sparks and very vulnerable to ESD shock due to limitations in silicon area, cost, and increased digital signal processing (DSP) requirements on chip (such as audio DSP algorithms).

It has been proposed to fix the problem by adding passive components (such as ferrites, varistors) within the coupling lines to protect the integrated circuitry. These passive components are costly and they require space on the PWB/PCB/FPC (footprint), and require extra logistical effort, slow down production and add complexity. Furthermore the performance of such systems is lower than a simple circuit with less losses and resistance.

The addition of a grounding contact/plate/pin within the connector/port/socket/jack can improve the ESD resistance of the system. For example in some port connectors or sockets a grounding contact/plate/pin is provided which would be the first contact when a member or plug is inserted. However in some connector/port/socket/jack designs such as a conventional 3.5 mm audio jack plug-socket design the grounding pin or contact is not the most exposed contact and as such an ungrounded contact can touch an pin or contact.

The concept with respect to the embodiments described herein is to provide a connector or socket (or means for providing an electrical interface) where at least one exposed contact (or means for receiving a conductive means) is coupled to (or operates as) a switch which mechanically closes or couples the contact to ground (or grounding terminal) in a first mode of operation and mechanically opens or releases the contact from ground (or is coupled to an electrical terminal interfacing an electrical signal between the connector and the member) in a second mode of operation having received the associated member or plug (or conductive means) or insert sufficiently so that the connector is configured to ground the member or plug and provide ESD protection.

Thus in some embodiments the connector/port/socket/jack is provided with a spring contact which is in a resting position configured to 'ground' the contact but having received the member or plug sufficiently produces a clear path to the desired components.

FIG. 1 shows a schematic representation of an electronic device or apparatus 10 comprising a suitable connector/port/socket/jack 11. The suitable port/socket/jack 11 may be a 3.5 mm audio jack.

The apparatus 10 in some embodiments can be a mobile phone, portable audio device, or other means for outputting or playing sound. The apparatus 10 has a suitable connector/port/socket/jack 11 coupling the apparatus to the exterior environment.

The apparatus 10 is in some embodiments a mobile terminal, mobile phone or user equipment for operation in a wireless communication system.

In other embodiments, the apparatus 10 is any suitable electronic device configured to generate sound, such as for example a digital camera, a portable audio player (mp3 player), a portable video player (mp4 player) and a portable computer, for example a laptop PC. In some other embodiments the apparatus 10 can be any suitable audio or audio subsystem component or any suitable audio capture/audio rendering device In some embodiments, the apparatus 10 comprises a sound generating/receiving module 19 which is linked to a processor 15. The processor 15 can be configured to execute various program codes. The implemented program codes may comprise a code for controlling the outputting and receiving of sound waves.

The implemented program codes in some embodiments 17 can be stored for example in the memory 16 for retrieval by the processor 15 whenever needed. The memory 16 could further provide a section 18 for storing data, for example data that has been processed in accordance with the embodiments. The code can, in some embodiments, be implemented at least partially in hardware or firmware.

In some embodiments the processor 15 is linked via a digital-to-analogue converter/analogue-to-digital converter (DAC/ADC) 12 to the transducer 11. The digital-to-analogue converter/analogue-to-digital converter (DAC/ADC) 12 can be any suitable converter.

The processor 15 can be further linked to a transceiver (TX/RX) 13, to a user interface (UI) 14 and to a display (not shown). The user interface 14 can enable a user to input commands or data to the apparatus 10. Any suitable input technology can be employed by the apparatus 10. It would be understood for example the apparatus in some embodiments could employ at least one of a keypad, keyboard, mouse, trackball, touch screen, joystick and wireless controller to provide inputs to the apparatus 10.

Although the example connector/port/socket/jack shown herein is a 3.5 mm audio jack it would be understood that embodiments can be applied to any suitable connector/port/socket/jack such as an A/V jack.

Figure 2:
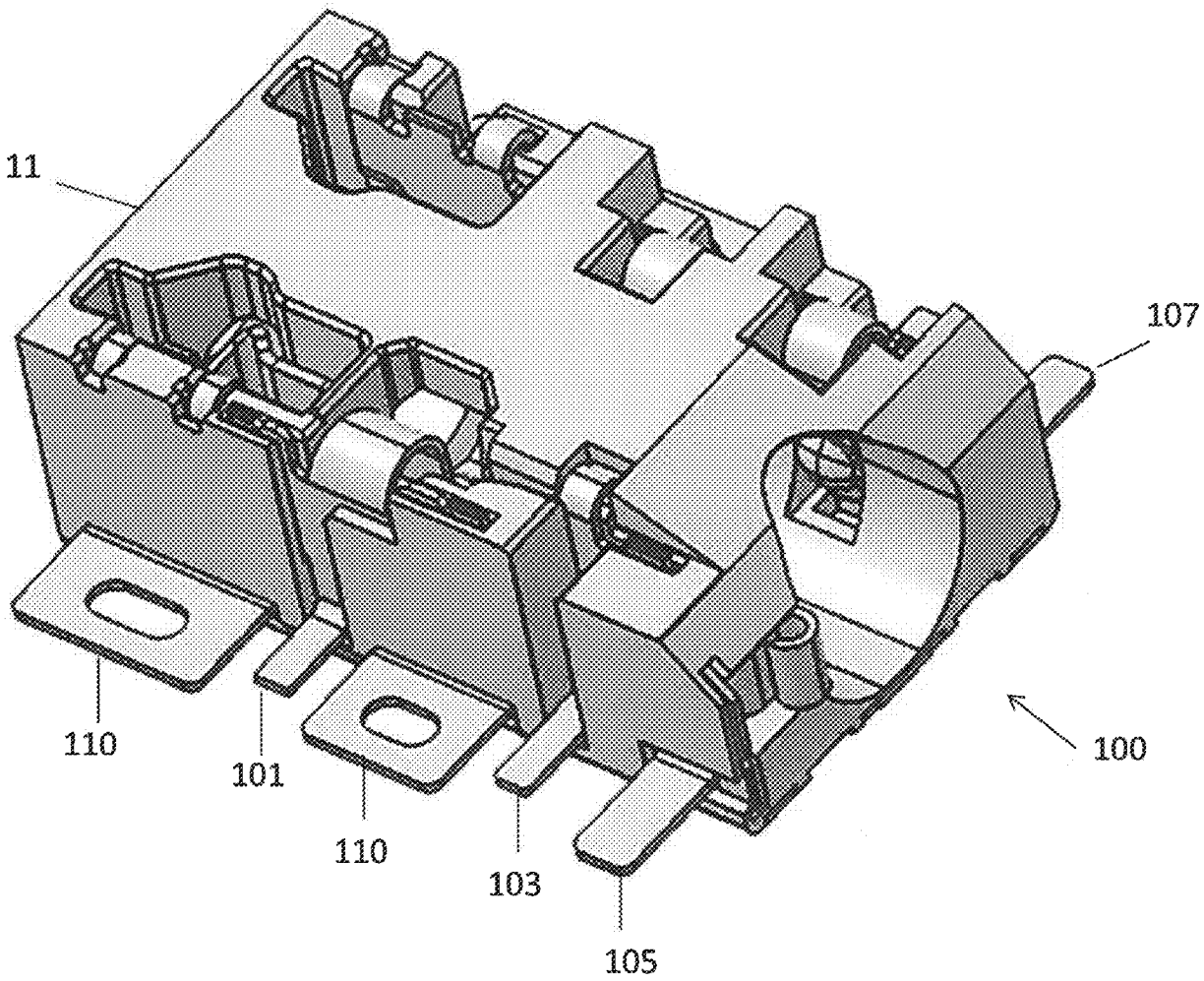
FIG. 2 illustrates a schematic isometric projection of the audio jack socket suitable for employing some embodiments.

With respect to FIG. 2 an example isometric projection of an audio jack (or socket) is shown. The isometric view shows the 3.5 mm audio jack 11 which comprises a moulding or casing containing support elements 110 for mounting the audio jack on a suitable support structure such as printed wiring board/printed circuit board/flexible printed circuit or a casing. Furthermore the audio jack 11 is shown comprising several external electrical contacts which are configured to be coupled to associated parts of an audio member or plug and furthermore electrically be coupled to components external to the audio jack. The audio jack 11 shown in FIG. 2 and described herein is one suitable for receiving a four contact audio plug, and therefore coupling a left and right audio channel, an input microphone channel and a common ground channel. Furthermore in some embodiments the audio jack can be configured to receive other types of audio plug and determine which type of plug has been inserted. For example as shown in the following examples the audio jack comprises contacts which act to determine the type of plug inserted. For example whether a four conductor point plug has been inserted (suitable for providing stereo out and microphone and signalling) and furthermore in some embodiments the type of four conductor point plug inserted for example whether the plug is an AHJ (American headset tack) standard or a OMTP (open Mobile Terminal Platform) standard headset.

The audio jack 11 in FIG. 2 is shown comprising (in order from the audio jack opening for receiving the audio plug) an external microphone terminal 105, a first external detect switch terminal 103, and a second external detect switch terminal 101 all on the left-hand side of the audio jack and an external ground terminal 107 on the right-hand side of the audio jack.

Figure 3:
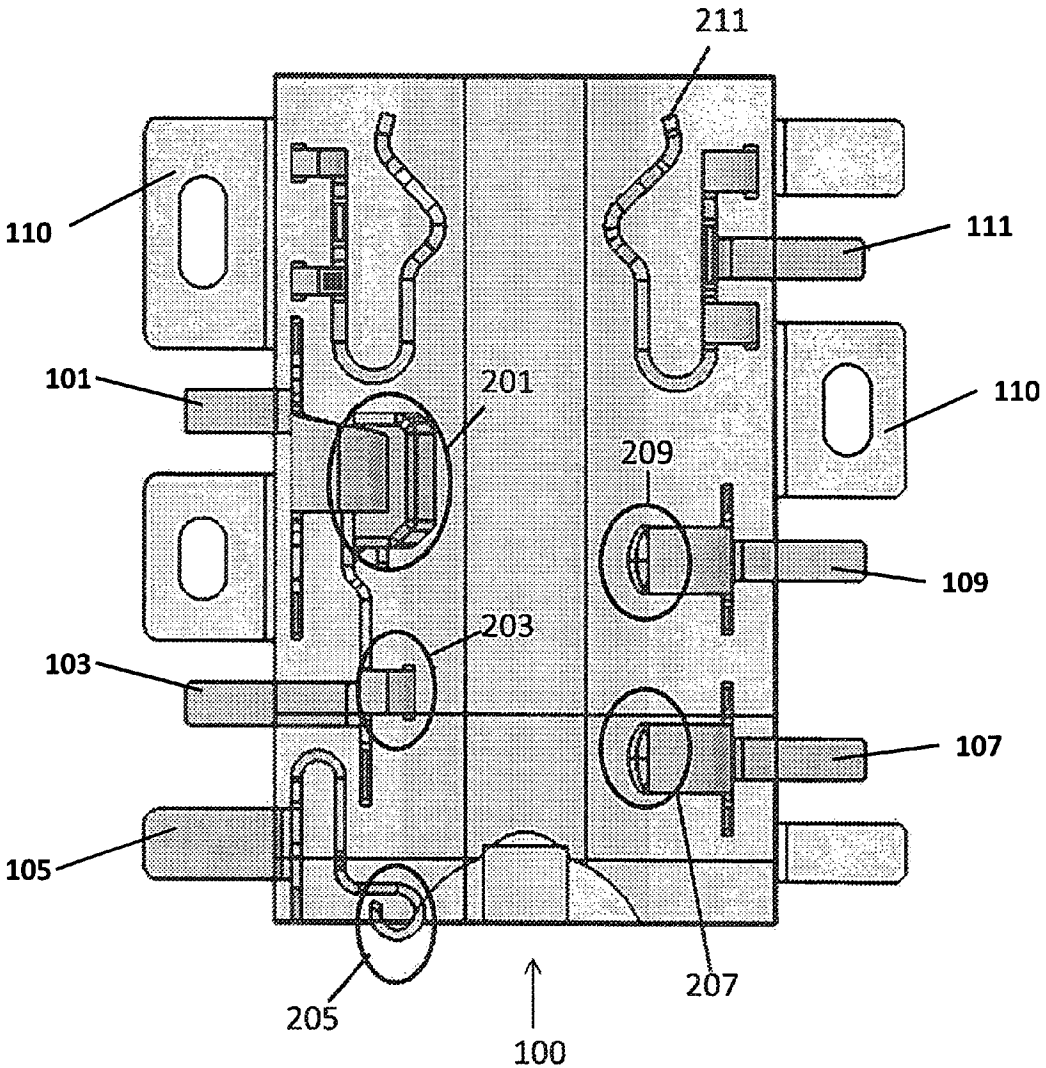
FIG. 3 illustrates a schematic sectioned projection of a prior art audio jack socket.

With respect to FIG. 3 an example cross-sectional view through a known audio jack is shown. The audio jack is sectioned such that the audio plug can be configured to be inserted into the jack from the bottom of the audio jack and in an upwards direction in the direction shown by the arrow 100.

The sectioned view of the audio jack 11 is shown comprising the external terminals and the couplings to the interior terminals configured to couple the audio jack to the audio plug. For example the audio jack 11 comprises an external microphone terminal 105 which is coupled to the microphone contact 205, the external ground terminal 107 which is shown coupled to the ground contact 207, the first external detect switch terminal 103 which is shown coupled to the first detect switch contact 203, an external right audio terminal 109 which is coupled to a right channel contact 209, the second external detect switch terminal 101 coupled to the second detect switch contact 201 and an external left channel terminal 111 coupled to a left channel contact 211.

It would be understood that in some embodiments such as shown with respect to the audio jack or connector the contact can be located at the opening of the connector. Furthermore in some embodiments the contact is located proud or protruding from of the opening of the connector such that the contact connects with the plug or member as the plug or member is inserted into the connector.

Furthermore although the examples shown herein describe the operation of a microphone terminal, in other words in operation the contact is configured to receive signals from the member or jack, it would be understood that in some embodiments the terminal is configured to be coupled to an external device via the plug or member, and further configured to transmit a signal from the connector to the external device via the plug or member.

Figure 4:
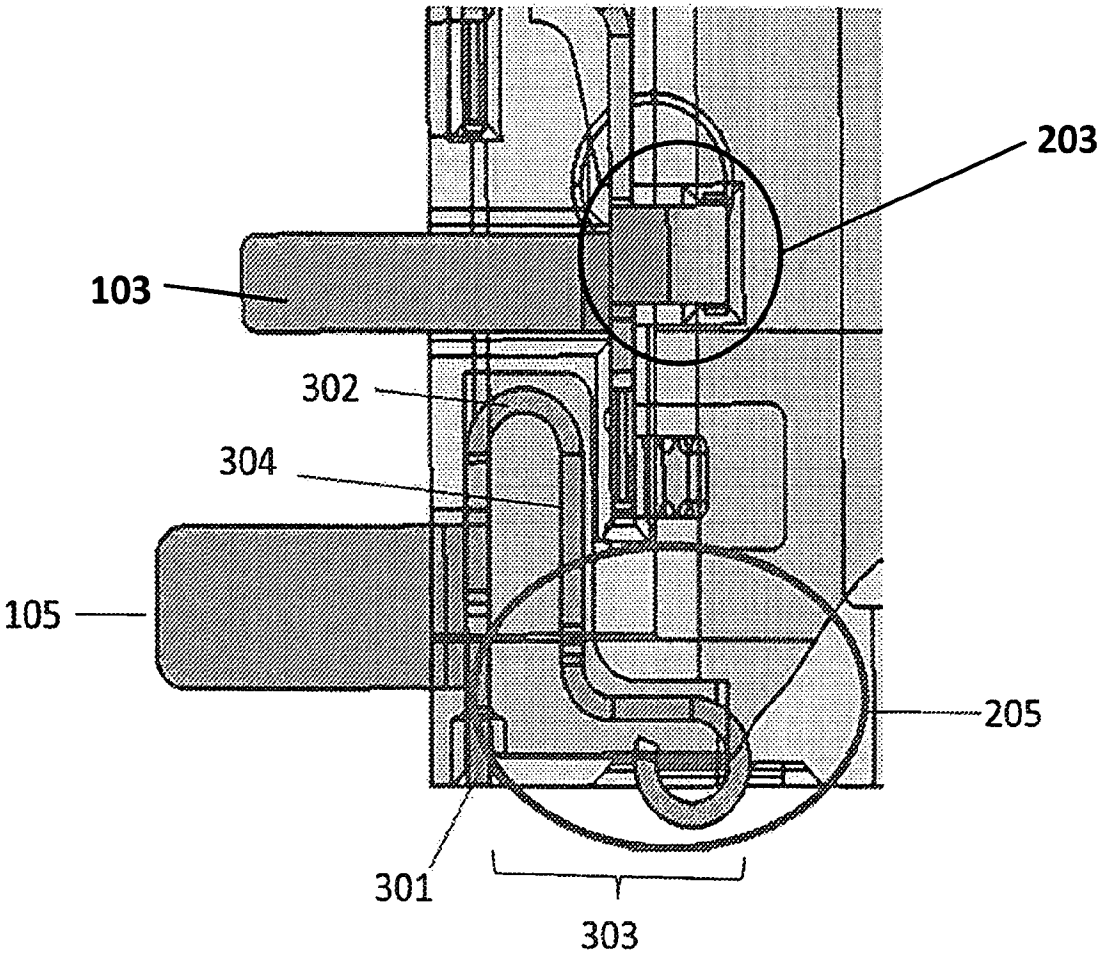
FIG. 4 illustrates a section of the schematic sectioned projection of a prior art audio jack socket as shown in FIG. 3.

With respect to FIG. 4 a detail of the audio jack is shown in FIG. 3 is shown. The detail showed in FIG. 4 shows the microphone contact 205, the exterior microphone terminal 105 which are coupled by a suspension or spring 303 between the microphone contact 205, the exterior microphone terminal 105. In the example shown in FIG. 4 the suspension or spring 303 is fixed or located by a first arm 301 which is coupled to the exterior microphone terminal 105 and comprises a movable second arm 304 which is coupled to or forms the microphone contact 205. In the example shown in FIG. 4 the microphone contact 205 is formed by a curved section of the end of the movable second arm 304. The movable second arm 304 is coupled to the first arm by a resilient or spring section 302. In the example shown in FIG. 4 the resilient or spring section is formed by a substantially 180 degree bend in the conductive or metal part comprising the first and the second parts. The spring section 302 is configured such that it provides a resting position enabling the microphone contact 205 to be biased towards the audio plug as it is inserted but be flexible enough to move away from the plug as it is inserted. In other words suspension enables the microphone contact to maintain a positive contact with the plug as it is inserted and so maintain a good electrical connection with the plug.

Figure 5:
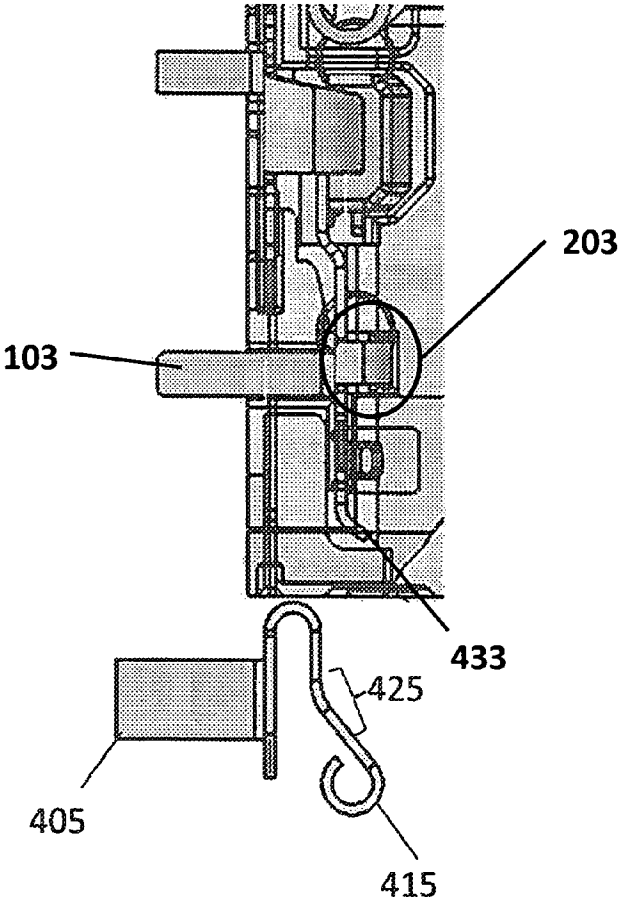
FIG. 5 illustrates a schematic sectioned projection of an audio jack socket according to some embodiments with switch pin extracted.

With respect to FIG. 5 a schematic sectioned projection of an audio jack socket according to some embodiments is shown with the microphone contact 415, the exterior microphone terminal 405 and the suspension or spring 425 extracted in order to show the concept described herein.

In this example the suspension or spring comprises a first arm which is coupled to the exterior microphone terminal 405, a resilient or spring section (which as shown in FIG. 4 is formed by a substantially 180° bend in the material to provide a bending moment spring) and a movable second arm which is coupled to or forms the microphone contact 415 but further comprises a knee or curved section 425 configured to be able to contact and couple a grounded contact 433 within the jack. In the example shown in FIG. 5 the knee angle is approximately 135 degrees, however it would be understood that any suitable bend angle (or any second arm shape or form) which enables a section of the second arm to contact the grounded contact when the suspension is in a resting state can be employed.

In other words the contact, which is conductive, can comprise a contact portion which is part of or coupled to a further part or arm of the contact, and wherein the contact portion can be configured to receive a plug or member which moves the further part of the contact away from a grounded connector against the bias of the resilient or spring section or portion of the contact and therefore breaking the contact from the contact position or further part or arm and a ground terminal or connector.

In some embodiments the contact is a metal pin or strip comprising a first arm fixed to the connector, a bended portion which at one end is coupled to the first arm and operating as the spring or resilient section or portion, and a second arm coupled the bended portion at the other end, the second arm configured to operate as the first part of the conductive contact and the contact portion.

In the example shown in FIG. 5 the grounded contact 433 is an extended first switch contact coupling within the audio jack, however it would be understood that the grounded contact 433 can be a dedicated grounded contact or a common grounded contact.

The grounded contact 433 furthermore is shown having a profile which matches the profile of the knee or curved section of the second arm. However it would be understood that any suitable profile or shape can be employed provided the grounded contact 433 is configured to receive the second arm part of the suspension or spring when in a resting or relaxed state.

Figure 6:
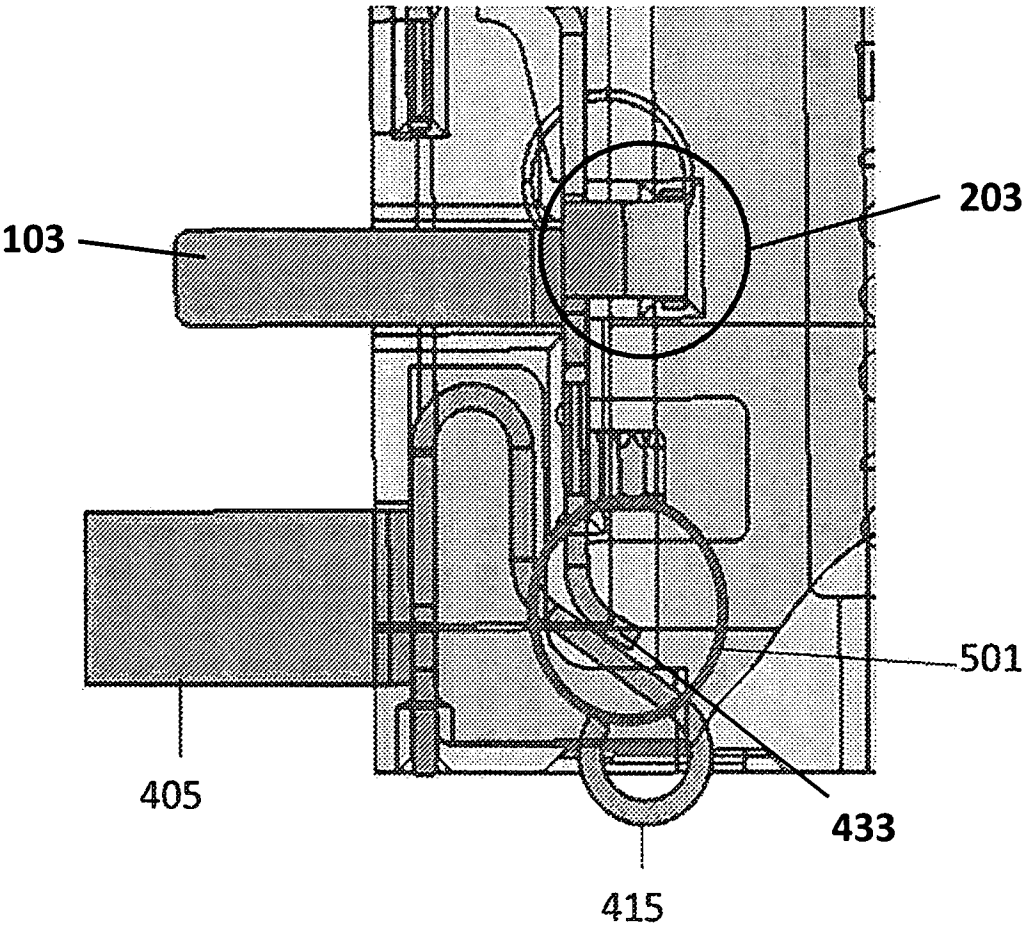
FIG. 6 illustrates a section of the schematic sectioned projection of the audio jack socket as shown in FIG. 5 according to some embodiments with switch pin closed.

This coupling of the grounded contact 433 and the suspension or spring in a resting state can be shown with respect to FIG. 6. In FIG. 6 a detail of the sectioned audio jack shows the region of contact 501 between the grounded contact 433 and the suspension or spring in a resting state. In other words the grounded contact 433 and the suspension or spring effectively form a mechanical switch which in a resting state is closed coupling the microphone contact 415 via the grounded contact 433 to ground (or earth) and as such providing a suitable ESD path to ground.

Figure 7:
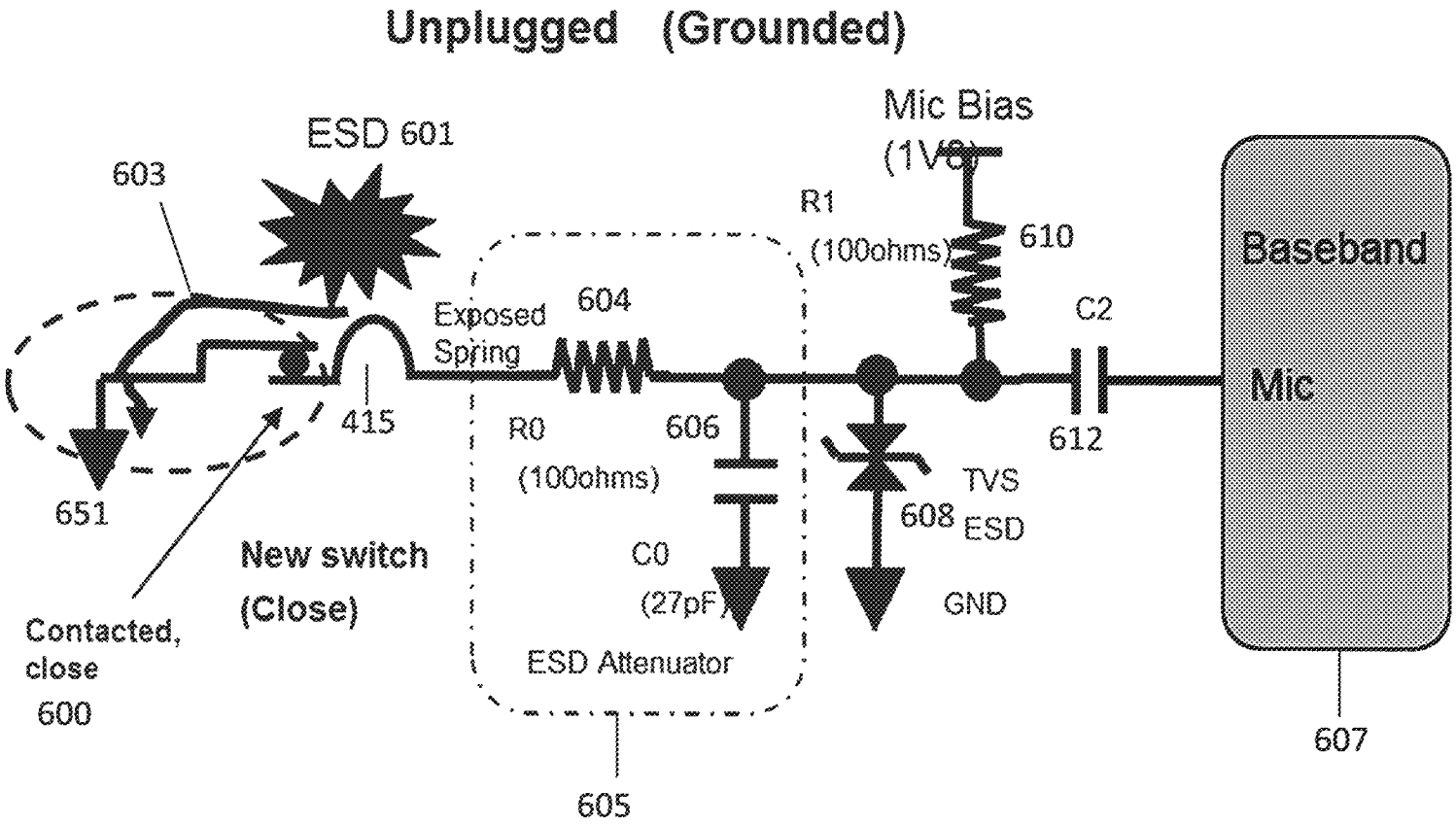
FIG. 7 illustrates an example circuit diagram comprising the audio jack with switch pin closed according to some embodiments.

The effect of the mechanical switch is shown with respect to FIG. 7 which shows the microphone contact (or exposed spring) 415 in a resting or relaxed state which closes the mechanical switch 600. Furthermore where an electrostatic discharge (ESD) 601 contacts the microphone contact the ESD passes through the closed mechanical switch 600 to ground 651 as shown by the line 603. In such a way it avoids passing through a ESD attenuator circuit 605 comprising a first series resistor 604 and first parallel capacitor 606, to a TVS ESD diode 608, a microphone bias resistor 610 and d.c. blocking capacitor 612 before passing to the microphone circuitry 607.

Figure 8:
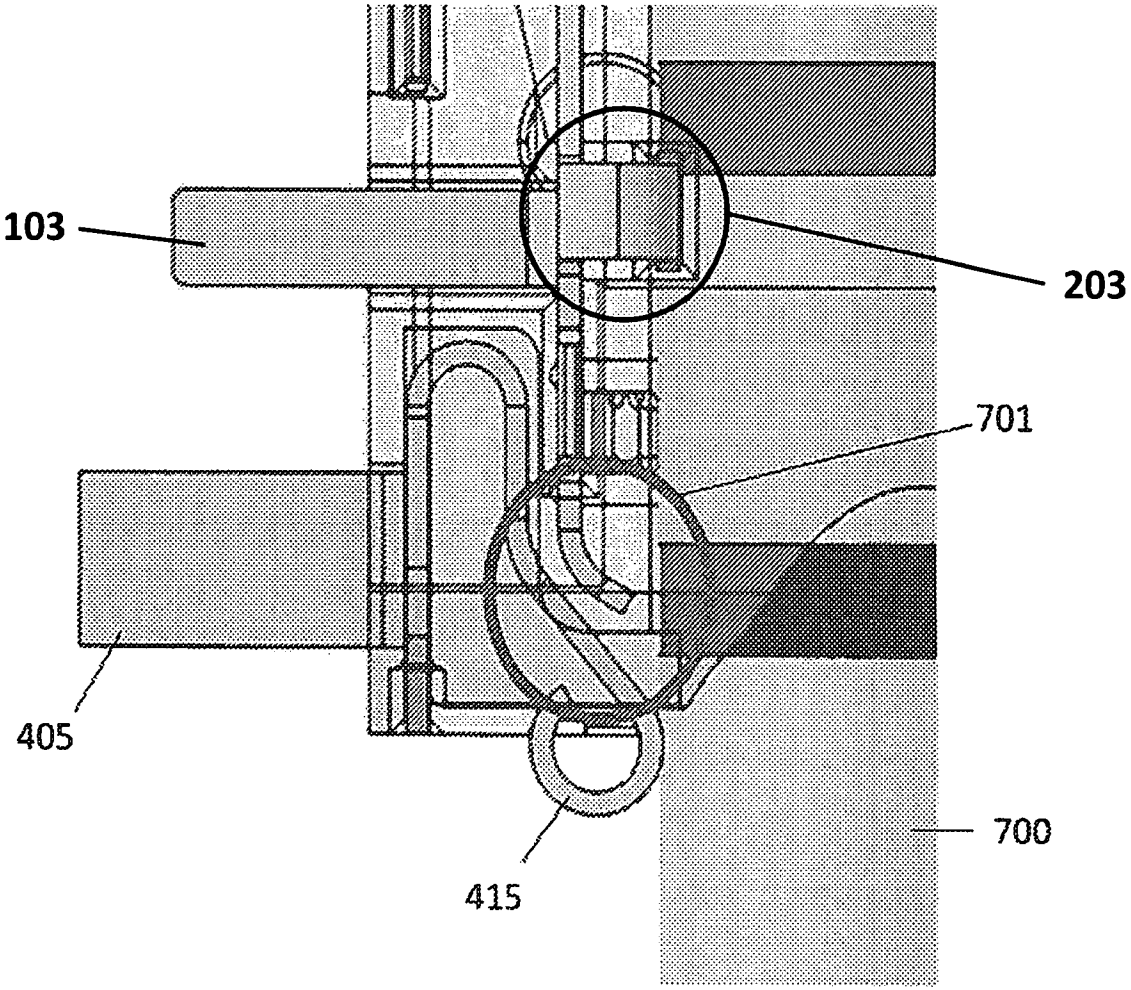
FIG. 8 illustrates a section of the schematic sectioned projection of the audio jack socket as shown in FIG. 5 according to some embodiments with switch pin open.
Figure 9:
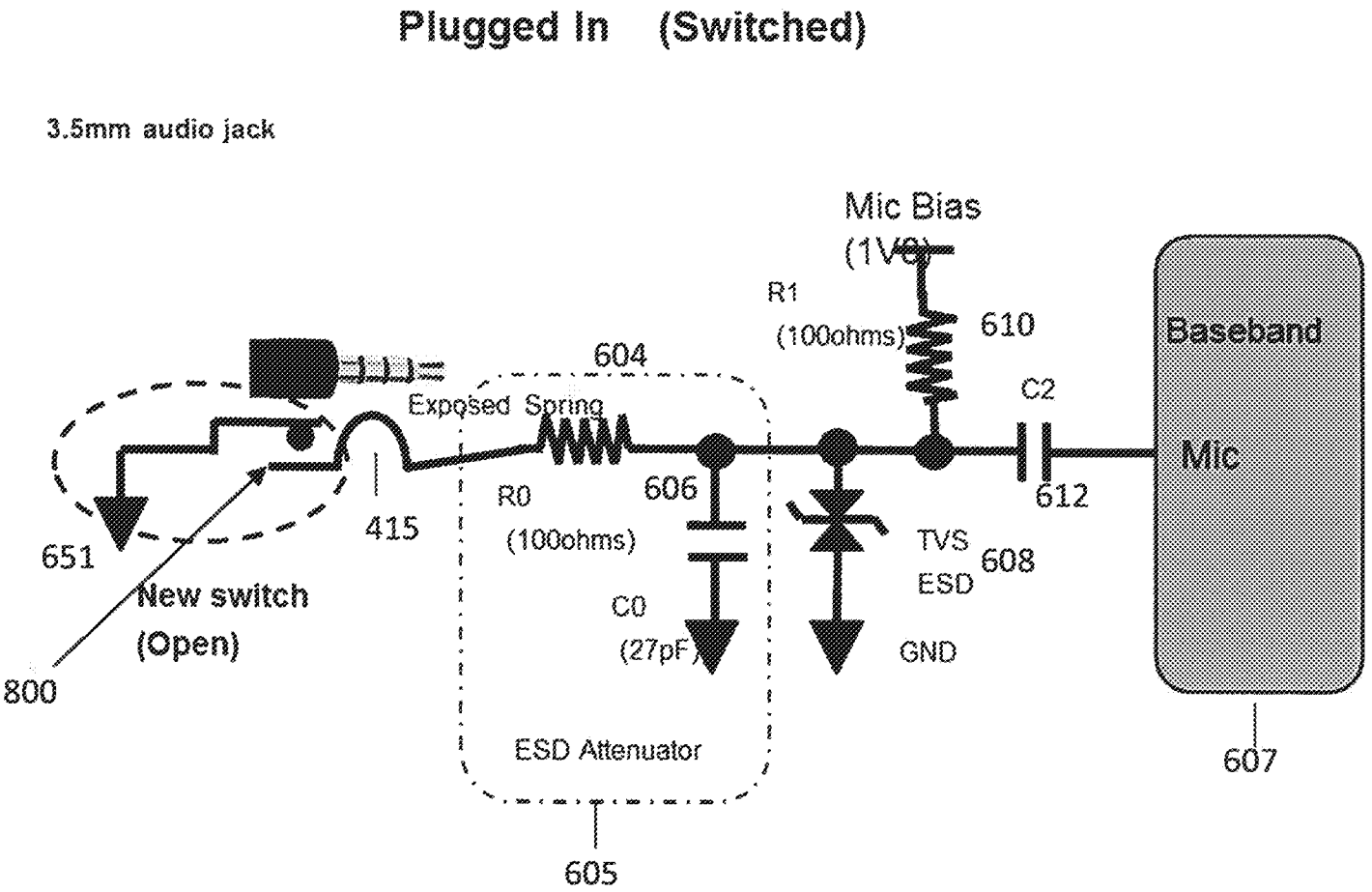
FIG. 9 illustrates an example circuit diagram comprising the audio jack with switch pin open according to some embodiments.

With respect to FIGS. 8 and 9 the example audio jack shown in FIGS. 5 and 6 are further shown. In FIG. 8 the example audio jack shown in FIGS. 5 and 6 is shown where the audio jack has received the associated audio plug 700. Furthermore with respect to FIG. 9 the circuit shown in FIG. 7 is shown with the mechanical switch having been opened by the insertion of the audio jack plug.

For example with respect to FIG. 8 the insertion of the audio plug 700 is shown having forced the microphone contact away from the resting position and pushing the movable second arm (which is coupled to or forms the microphone contact) so that it is no longer coupled to or in contact with the grounded contact. In other words the insertion of the audio plug 700 within the audio jack causes the opening 701 of the mechanical switch formed by the moveable second arm of the suspension or spring and the grounded contact such that and the microphone contact is only coupled to the exterior microphone terminal 405 and not to ground.

This is shown in FIG. 9 wherein the insertion of the audio plug opens the switch 800 and as such the microphone contact 415 is coupled via the ESD attenuator circuit 605 comprising a first series resistor 604 and first parallel capacitor 606, the TVS ESD diode 608, the microphone bias resistor 610 and d.c. blocking capacitor 612 to the microphone circuitry 607.

Figure 10:
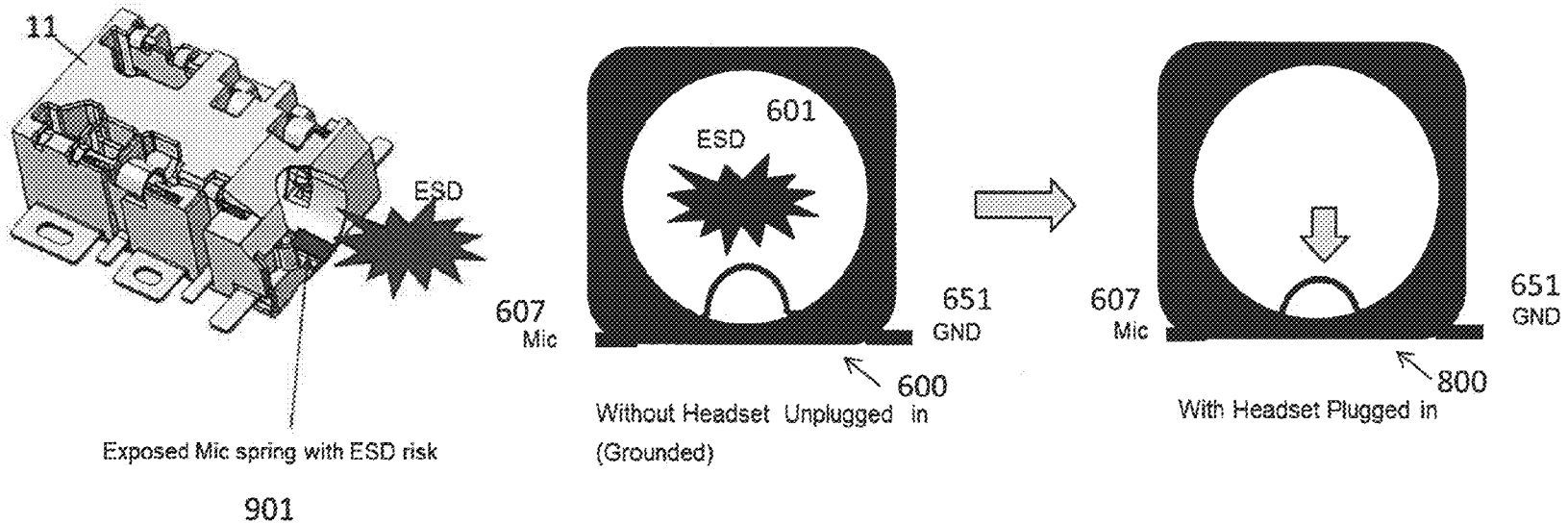
FIG. 10 illustrates the operation of the audio jack switch as shown in FIGS. 5 to 9.

With respect to FIG. 10 an audio plug point of view of the operation of the contact spring is described further. As shown in FIG. 10 the audio jack with exposed microphone contact or spring has an ESD risk 901. According to some embodiments as described herein without the headset plugged in (in other words without receiving a suitable audio plug) the microphone spring or contact configured to be coupled to ground 651 via the closed switch 600 whereas when the headset or audio plug is inserted the contact opens 800 between the spring and the ground 651 coupling the spring only to the microphone circuitry 607.

In other word according to some embodiments in normal unplugged status the spring (microphone contact) is exposed but grounded and in such a manner mitigates ESD impact. Whereas in plugged status the spring is switched to the microphone circuitry.

In such embodiments the switch is compliant with current audio jack logic. For example while the detecting pin of audio jack is not triggered (in other words unplugged) the microphone bias can be disabled. Furthermore there is no power consumption even when the contact is grounded by the microphone bias resistor (100 ohms). When the detecting pin of the audio jack is triggered (in other words plugged) the exposed spring is configured to disconnect ground and switch to the normal microphone circuit design.

It shall be appreciated that the term portable device is user equipment. The user equipment is intended to cover any suitable type of wireless user equipment, such as mobile telephones, portable data processing devices or portable web browsers.

In general, the various embodiments may be implemented in hardware or special purpose circuits, software, logic or any combination thereof. Some aspects of the invention may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware.

For example, in some embodiments the method of manufacturing the apparatus may be implemented with processor executing a computer program.

Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims. Indeed in there is a further embodiment comprising a combination of one or more of any of the other embodiments previously discussed.

The invention claimed is:

1. An apparatus comprising:

a connector for providing an electrical interface, the connector comprising an opening configured to receive a member, wherein the opening is at an exterior portion of the connector;

at least one conductive contact located at least partially within the connector and configured to operate as a switch such that when the connector is in an unplugged to partially plugged state the at least one conductive contact is grounded and when the connector is in a partially plugged to a fully plugged state the at least one conductive contact is coupled to an electrical terminal interfacing an electrical signal between the connector and the member, wherein the at least one conductive contact comprises a microphone contact protruding from the opening of the connector in a direction opposite an insertion direction of the member such that the conductive contact connects with the member as the member is inserted into the connector;

wherein the connector is an audio jack and wherein the electrical terminal is a microphone terminal.

2. The apparatus as claimed in claim 1, wherein the at least one conductive contact comprises a spring portion biased to couple at least a first part of the at least one conductive contact to a grounded connector.

3. The apparatus as claimed in claim 2, wherein the at least one conductive contact further comprises a contact portion coupled to the first part of the at least one conductive contact.

4. The apparatus as claimed in claim 3, wherein the contact portion is configured to receive the member and move the first part of the at least one conductive contact away from the grounded connector against a bias of the spring portion of the at least one conductive contact.

5. The apparatus as claimed in claim 3, wherein the at least one conductive contact further comprises a metal pin comprising a first arm fixed to the connector, a bended portion which at one end is coupled to the first arm and operating as the spring portion.

6. The apparatus as claimed in claim 5, wherein the at least one conductive contact comprises a second arm coupled to the bended portion at the other end, the second arm configured to operate as the first part of the at least one conductive contact and the contact portion.

7. The apparatus as claimed in claim 1, wherein the at least one conductive contact is located at the opening of the connector.

8. The apparatus as claimed in claim 1, wherein the member comprises at least one conductive contact configured to co-operate with the at least one conductive contact of the apparatus so as to provide an electrical interface with the connector.

9. The apparatus as claimed in claim 1, wherein the electrical terminal is configured to be coupled to an external device via the member.

10. The apparatus as claimed in claim 9, wherein the electrical terminal further configured to transmit a signal from the connector to the external device via the member.

11. A method comprising:

providing a connector for providing an electrical interface, the connector comprising an opening configured to receive a suitable member, wherein the opening is at an exterior portion of the connector;

providing at least one conductive contact located at least partially within the connector;

operating the at least one conductive contact as a switch such that when the connector is in an unplugged to partially plugged state the at least one conductive contact is grounded and when the connector is in a partially plugged to a fully plugged state the at least one conductive contact is coupled to an electrical terminal interfacing an electrical signal between the connector and the member, wherein the at least one conductive contact comprises a microphone contact protruding from the opening of the connector in a direction opposite an insertion direction of the member such that the conductive contact connects with the member as the member is inserted into the connector;

wherein the connector is an audio jack and wherein the electrical terminal is a microphone terminal.

12. The method as claimed in claim 11, further comprises biasing a spring portion of the at least one conductive contact for coupling at least a first part of the at least one conductive contact to a grounded connector.

13. The method as claimed in claim 12, further comprises coupling a contact portion of the at least one conductive contact to the first part.

14. The method as claimed in claim 13, further comprises receiving the member by the contact portion and moving the first part of the at least one conductive contact away from the grounded connector against a bias of the spring portion of the at least one conductive contact.

15. The method as claimed in claim 12, further comprises fixing a first arm of a metal pin of the at least one conductive contact to the connector, coupling a bended portion of the metal pin to the first arm for operating as the spring portion.

16. The method as claimed in claim 15, further comprises coupling a second arm of the at least one conductive contact to the bended portion at the other end and operating the second arm as the first part of the at least one conductive contact and the contact portion.

17. The method as claimed in claim 11, further comprises co-operating at least one conductive contact of the member with the at least one conductive contact of the apparatus so as to provide the electrical interface with the connector.

18. An apparatus comprising:

a casing configured to encapsulate the following components: at least one processor; at least one memory; at least one display; and a connector for providing an electrical interface, the connector comprising an opening configured to receive a suitable member, wherein the opening is at an exterior portion of the connector; at least one conductive contact located at least partially within the connector and configured to operate as a switch such that when the connector is in an unplugged to partially plugged state the at least one conductive contact is grounded and when the connector is in a partially plugged to a fully plugged state the at least one conductive contact is coupled to an electrical terminal interfacing an electrical signal between the connector and the member, wherein the at least one conductive contact comprises a microphone contact protruding from the opening of the connector in a direction opposite an insertion direction of the member such that the conductive contact connects with the member as the member is inserted into the connector, wherein the connector is an audio jack and wherein the electrical terminal is a microphone terminal.

* * * * *